United States Patent [19]

Richards

[11] 4,016,358

[45] Apr. 5, 1977

[54] ELECTRICAL INSULATOR WITH CONTAMINATION AND FLASH-OVER ELIMINATOR

[76] Inventor: Clyde N. Richards, 4887 Mission Blvd., San Diego, Calif. 92109

[22] Filed: Mar. 11, 1976

[21] Appl. No.: 666,023

[52] U.S. Cl. ..... 174/141 R; 174/211

[51] Int. Cl.[2] ..... H01B 17/48

[58] Field of Search ..... 174/30, 139, 140 R, 174/140 C, 140 H, 140 S, 140 CR, 141 R, 141 C, 144, 211

[56] References Cited

UNITED STATES PATENTS

| | | | |
|---|---|---|---|
| 1,291,217 | 1/1919 | Sonneborn | 174/141 R |
| 1,659,183 | 2/1928 | Austin | 174/140 H |
| 1,730,232 | 10/1929 | Newill | 174/141 R |
| 1,972,613 | 9/1934 | Austin | 174/141 R |

FOREIGN PATENTS OR APPLICATIONS

| | | | |
|---|---|---|---|
| 533,069 | 11/1921 | France | 174/140 R |
| 293,184 | 7/1928 | United Kingdom | 174/140 CR |

*Primary Examiner*—Laramie E. Askin

*Attorney, Agent, or Firm*—Bruno J. Verbeck; John L. Haller

[57] ABSTRACT

An improved insulator of the type having a dielectric body with a mounting pin below and a mounting cap above, where the mounting cap is capable of receiving and holding the mounting pin, and wherein the improvement comprises an upper metallic bowl-shaped member to dissipate high electric field concentrations and to protect the insulator from contamination, and a lower metallic member to dissipate high electric field concentrations. The insulator is adapted to be linked together with like insulators to form a chain of insulators.

4 Claims, 4 Drawing Figures

ELECTRICAL INSULATOR WITH CONTAMINATION AND FLASH-OVER ELIMINATOR

BACKGROUND OF THE INVENTION

1. Field of the Invention

This invention relates to an improved insulator for electrically insulating different electrical potentials. The form of these insulators provides for the linking of a number of individual insulators into a chain to produce a higher total insulation capacity.

2. Description of the Prior Art

Insulating devices of the type which incorporate a dielectric body and an upper and lower connecting means (i.e., cap and pin) are well known by those skilled in the art. Further, metallic disks are often used to help protect the insulator against weather, and to improve insulating characteristics (see U.S. Pat. No. 1,215,549, U.S. Pat. No. 1,659,183, U.S. Pat. No. 1,772,947, U.S. Pat. No. 2,048,016 and U.S. Pat. No. 3,832,482). The prior art devices with which I am familiar do not adequately protect the insulators from inclement weather, and other forms of atmospheric contamination, nor do they provide the increase in capacitance of each insulator that the claimed invention achieves, nor do they adequately dissipate the centers of high electric field concentrations.

SUMMARY OF THE INVENTION

This invention relates to an improved insulator whose particular configuration uniquely adapts it to protect the insulator from atmospheric contamination, to provide higher capacitance of the insulator, and to reduce centers of high electric field concentrations. The particular shape and size of the upper bowl-shaped member protects the insulator from contamination, and the curvilinear shape of the upper bowl-shaped member and of the lower member increases the capacitance of the insulator. The cooperation of the upper and lower members and the dielectric material of the insulator dissipates the centers of high electric field concentration.

An object of this invention is to provide an insulator whose surfaces are protected from atmospheric contamination.

A further object of this invention is to provide a means for dissipating and removing the regions of high electric field near the junction of the dielectric body of the insulator and its cap and pin.

A further object of this invention is to provide a means for increasing the voltage necessary to cause flash-over when the insulator is wet and/or contaminated, and if flash-over does occur, to cause such in the air, away from the dielectric surface.

A further object of this invention is to provide an insulator having increased capacitance and better voltage distribution when such insulators are linked together to form a chain of insulators.

A further object of this invention is to provide an insulator which is suitable for insulating either alternating current power sources or direct current power sources.

BRIEF DESCRIPTION OF THE DRAWINGS

The following is a brief description of the accompanying drawings.

DESCRIPTION OF THE PREFERRED EMBODIMENT

Figure 1:
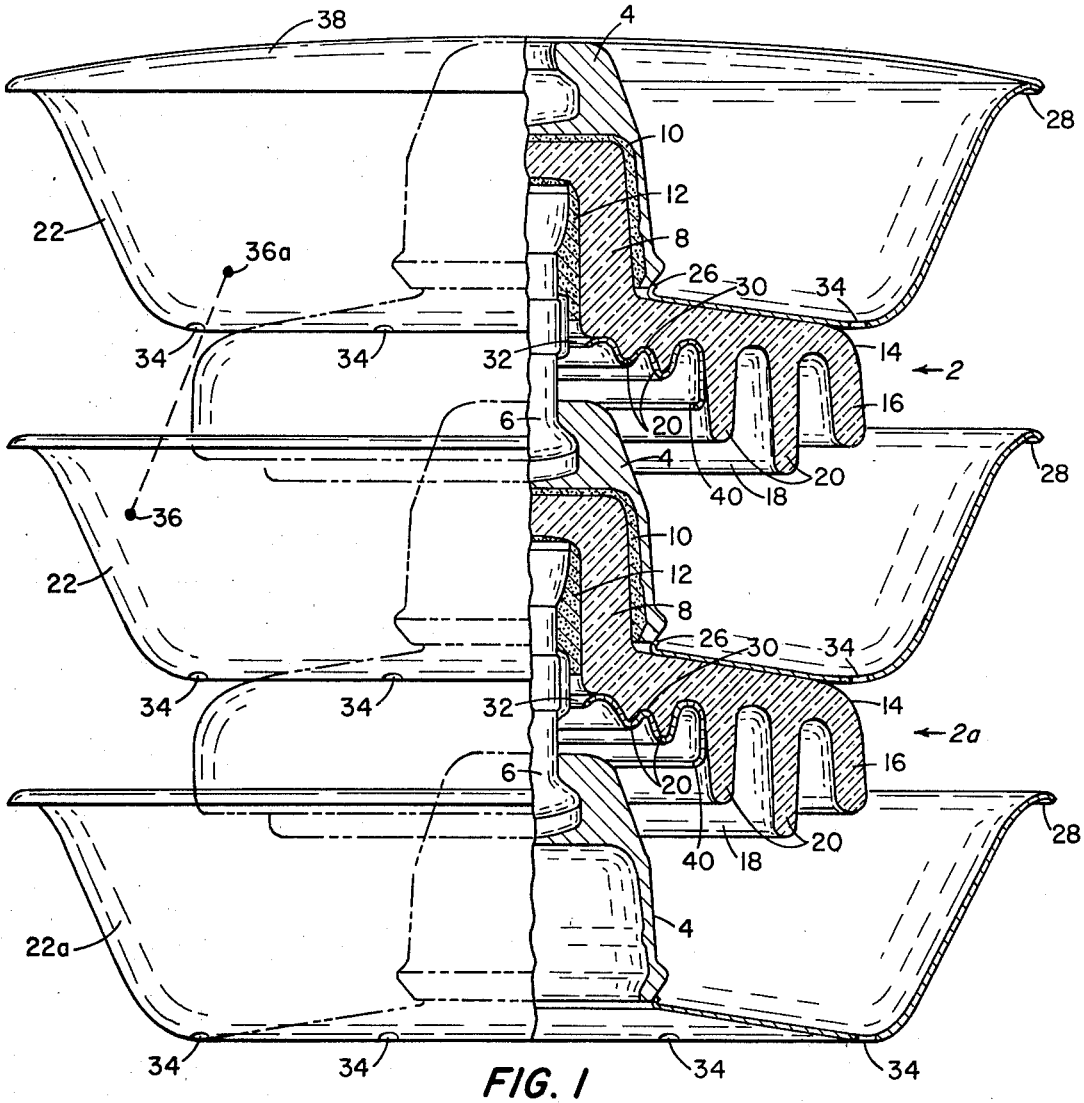
FIG. 1 is an elevation, partially in section, of two linked insulators embodying the invention.

FIG. 1 of the drawings shows two insulators 2 and 2*a*, linked together. As best seen in the partial section, the metallic cap 4 of the lower insulator 2*a* receives the metallic pin 6 of the upper insulator 2. The cap 4 is generally secured to the dielectric body 8 of the insulator 2 by any suitable means such as cement 10. Similarly, the pin 6 is generally secured to the dielectric body 8 of the insulator 2 by any suitable means such as cement 12. The upper surface 14 of the dielectric body 8 extends outwardly and downwardly towards the flange 16. The lower surface 18 of the dielectric body 8 has a plurality of downwardly extending petticoats 20.

Figure 2:
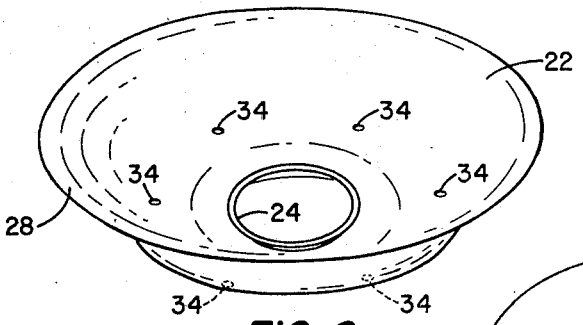
FIG. 2 is an oblique view of the upper member as seen from above.

FIG. 2 shows the electrically conductive, non-corrosive, bowl-shaped upper member 22 having an opening 24 through its center. FIG. 1 shows the upper member 22 fitting over cap 4 at 26, and being securely held to the cap 4 and against the top surface 14 of the dielectric body 8. The upper member 22, in electrical contact with the cap 4, extends outwardly in contact with the upper surface 14 of the dielectric body 8. The upper member 22 continues in an outwardly and slightly downwardly direction so that the lowest point on the upper member 22 is outside the perimeter of the dielectric body 8. The upper member 22 then curves gradually upward and at its outer edge, the upper member 22 curves outwardly again to form a lip 28. The lip 28 of the lower insulator 2*a* is above and outside the flange 16 of the insulator above. The height to which the upper member 22 extends relative to the flange 16 of the insulator 2 above is not critical and extends above the flange 16 in FIG. 1 for demonstration purposes only. Depending upon the environment, the lip 28 may be even with, above, or below the flange 16 without sacrificing the operating characteristics of the invention.

FIG. 1 also shows a top plate 38 installed over the top of the upper member 22 of the uppermost insulator 2 to prevent the collection of water and other debris. A bottom upper member 22*a* is provided to achieve linearity in the electrical characteristic of a chain of insulators. The bottom upper member 22*a* which is secured to the bottom of a chain of like insulators by any of a number of satisfactory methods has the same conformation and is interchangeable with all other upper members 22. The top plate 38 and the bottom upper member 22*a* are described for illustrative purposes only.

Figure 3:
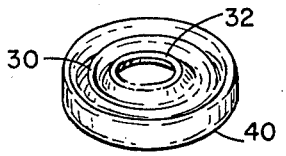
FIG. 3 is a oblique view of the lower member as seen from above.

FIG. 3 shows the electrically conductive, non-corrosive lower member 30 having an opening 32 through its center. FIG. 1 shows the lower member 30 fitting over the pin 6 at 32, and conforming to and being held against the lower surface of the insulator 2. The lower member 30 is in electrical contact with the pin 6 and extends over approximately one half the lower surface 18. The outer edge of the lower member 30 leaves the dielectric body 8 in a gradual manner at 40.

Figure 4:
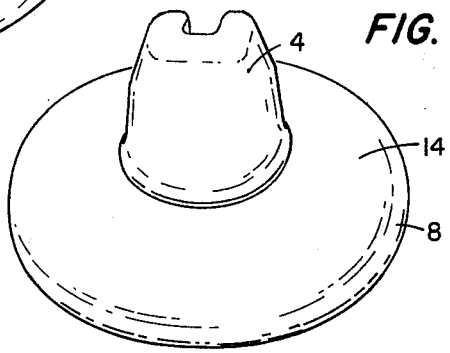
FIG. 4 is an oblique view of the dielectric body of the insulator as seen from above.

FIG. 4 shows the top of the dielectric body of 8 with the cap 4 in place.

The nested effect of the higher insulator 2 fitting inside the upper member 22 of the lower insulator 2*a* creates the high resistance to atmospheric contamination, such as rain, fog, dust, etc. Further, because of the close fit of the upper member 22 and the lower member 30 to the upper surface 14 and the lower surface 18, respectively, and because of the electrical contact between the cap 4 and upper member 22 and the electrical contact between the pin 6 and the lower member 30, the centers of high electric field concentrations around the bottom of the cap 4 and around the upper portion of the pin 6 are substantially dissipated. It is this particular configuration of the insulator 2, the upper member 22 and lower member 30 that dissipates centers of high electric field concentration and increases the capacitance of the insulator, thus reducing tendency for flash-over even if the insulator is contaminated.

Circumferentially spaced drain-openings 34 are positioned in the bottom of the upper member 22 outside that portion of the upper member 22 which is in contact with the upper surface 14 of the dielectric body 8. These drain-openings 34 are adapted to allow rain and atmospheric contaminants to drain from the upper member 22. By way of example only, six drain-openings may be symmetrically spaced around the bottom of the upper member 22. Each drain-opening may be, for example, a hole whose diameter is .125 inch. An important characteristic of the drain-openings is that they must be small enough to prevent a constant flow or stream of water from escaping and electrically shorting out adjacent insulators. These drain-openings 34 are included to show an example of one method of eliminating water (rain) from the upper member 22. The drain-openings are not essential, but may be utilized where regional climatic conditions warrant.

The shape of the upper member 22 prevents the formation of water (rain) droplets on its lower surfaces and thus tends to prevent the formation of a source for flash-over discharges. By way of illustration only, the described shape of the upper member 22 can withstand and thus prevent flash-over discharges, between the upper member 22 of the upper insulator 2 and the upper member 22 of the lower insulator 2*a* in electric fields which may be, for example, ten thousand volts per centimeter. The lower member 30 can withstand electric fields which may be, for example, four thousand volts per centimeter; however, because the entire lower area is essentially at the same electrical potential, the region is essentially free from such discharges.

When discharges do occur, they are generally precipitated by large line surges or lightning striking the power lines and the flash-over occurs between two upper members 22 of adjacent insulators. For example, generally flash-over occurs between points 36 and 36*a*, where said points represent substantially the closest approach between the upper members 22 of adjacent insulators 2. This position of closest approach is controlled by the shape of the upper member 22 and may be, for example, equal to approximately ⅔ the height of an individual dielectric body 8.

The addition of the upper member 22 and the lower member 30 to the dielectric body 8 increases the capacitance of each insulator 2 and corresponding to a chain of insulators. Because of the increased capacitance of each insulator 2, a chain of insulators exhibits a better, more linear, voltage distribution. The upper members 22 and lower member 30 are attached in a manner that enables the operation of the insulators, alone or in a chain, in either the vertical position (as shown in FIG. 1), the horizontal position, or in any incline position.

The insulators 2 claimed in this invention display a higher flash-over voltage when wet and any non-conductive coating on the upper member 22 or lower member 30 will not hurt the performance of the device.

The invention as discussed and embodied herein is suited to or suitable for all configurations of dielectric bodies.

For illustration purposes only, the particular physical characteristics of relevant features of the improved insulators 2 are hereinafter presented. The outside diameter of the upper member 22 may be, for example, 24 inches. That portion of the upper member 22 which is in contact with the upper surface 14 of the dielectric body 8 may have, for example, a width of 2.5 inches. The radius of curvature which describes the curvilinear shape of the upper member 22 may be, for example, a minimum of 4 inches everywhere except for the reverse curve at the lip 28 of the upper member 22. The radius of curvature of the lip 28 may be, for example, 0.5 inch. The outside diameter of the lower member 32 may be, for example, 6 inches. The radius of curvature of the outside edge of lower member 32 may be, for example, 1 inch. The material used to fabricate both the upper member 22 and the lower member 32 may be, for example, 0.056 gauge sheet material. Among the materials that can satisfy the requirements of the improved insulator 2 include stainless steel, copper, aluminum, zinc-coated steel, brass, a structural plastic coated with a conductive, non-corrosive material or any suitable conductive material with a non-corrosive surface. These physical characteristics are presented only for purposes of illustration and many variant combinations of these parameters can be developed within the concept of this invention by those skilled in the art; however, the precise structure described above is very effective.

Since using the above description, those skilled in the particular art of insulator fabrication could easily construct this or variant forms of this improved insulator, such variant forms are to be considered within the scope and essence of this invention.

What is claimed is:

1. An improved electrical insulator adapted to be linked together with like insulators into a chain of such insulators, said insulator having a dielectric body provided with an upper surface which has an outwardly and downwardly extending flange and a lower surface which has a plurality of downwardly extending petticoats, a lower mounting means which is conductive, which is secured within said dielectric body and which protrudes from the lower surface, and an upper mounting means, which is conductive and is secured to the top of said dielectric body to receive and hold the lower mounting means of a second insulator to be positioned above, wherein the improvement comprises: a conducting non-corrosive upper member which is secured to the upper surface of the insulator and in electrical contact with the upper mounting means whereby to dissipate high electric fields which exist between the bottom edge of the upper mounting means and the upper surface of the insulator, said upper member extending radially outward so that the outer perimeter of the upper member extends beyond the flange of the upper surface of said insulator, whereby to protect the insulator from atmospheric contamination; and a conducting non-corrosive lower member which is secured to the lower surface of the insulator and is in electrical contact with the lower mounting means whereby to dissipate high electric fields which exist between the upper portion of the lower mounting means and the lower surface of the insulator, said lower member conforming to the shape of the lower surface of the insulator;

2. An improved insulator as recited in claim 1, wherein the upper member is (a) bowl-shaped, and has an opening through its center capable of accepting the upper mounting means, (b) is in contact with the upper surface of the insulator as it extends outwardly from the upper mounting means, (c) curves upwardly at the outer edge of the insulator so that the top of the upper member will be outside the flange of the second insulator when positioned above, and (d) wherein the outside edge of the upper member curves outwardly to form a lip.

3. An improved insulator as recited in claim 1, wherein the diameter of said lower member is substantially less than that of the dielectric body.

4. An improved insulator as recited in claim 1, wherein a plurality of circumferentially disposed drain-openings are provided in the bottom of the upper member to permit collected water and debris to escape.

* * * * *